US011142963B2

(12) United States Patent
Oyedokun et al.

(10) Patent No.: US 11,142,963 B2
(45) Date of Patent: Oct. 12, 2021

(54) OPTIMIZED COILED TUBING STRING DESIGN AND ANALYSIS FOR EXTENDED REACH DRILLING

(71) Applicant: LANDMARK GRAPHICS CORPORATION, Houston, TX (US)

(72) Inventors: Oluwafemi I. Oyedokun, Bryan, TX (US); Robello Samuel, Cypress, TX (US); Gareth M. Braund, Houston, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 356 days.

(21) Appl. No.: 15/770,183

(22) PCT Filed: Dec. 16, 2015

(86) PCT No.: PCT/US2015/066014
§ 371 (c)(1),
(2) Date: Apr. 20, 2018

(87) PCT Pub. No.: WO2017/105430
PCT Pub. Date: Jun. 22, 2017

(65) Prior Publication Data
US 2018/0305989 A1 Oct. 25, 2018

(51) Int. Cl.
*E21B 17/20* (2006.01)
*E21B 7/06* (2006.01)
*E21B 44/00* (2006.01)

(52) U.S. Cl.
CPC ..... *E21B 17/20* (2013.01); *E21B 7/061* (2013.01); *E21B 44/00* (2013.01)

(58) Field of Classification Search
None
See application file for complete search history.

(56) References Cited

U.S. PATENT DOCUMENTS 6,438,495 B1 8/2002 Chau et al.
2009/0319241 A1 12/2009 Samuel
(Continued)

FOREIGN PATENT DOCUMENTS

WO WO-2012016045 A1 2/2012
WO WO-2015030799 A1 3/2015

OTHER PUBLICATIONS

Korean Intellectual Property Office, International Search Report and Written Opinion, PCT/US2015/066014, dated Sep. 7, 2016, 10 pages, Korea.

(Continued)

*Primary Examiner* — Leslie J Evanisko
*Assistant Examiner* — Leo T Hinze

(57) ABSTRACT

System and methods for optimizing coiled tubing string configurations for drilling a wellbore are provided. A length of a rotatable segment of a coiled tubing string having rotatable and non-rotatable segments is estimated based on the physical properties of the rotatable segment. A friction factor for the rotatable segment is calculated based on the estimated length. An effective axial force for one or more points of interest along the non-rotatable and rotatable string segments is calculated, based in part on the friction factor. Upon determining that the effective axial force for at least one point of interest exceeds a predetermined maximum force threshold, an effective distributive friction factor is estimated for at least a portion of the non-rotatable segment of the string. The rotatable and non-rotatable string segments are redefined for one or more sections of the wellbore along a planned trajectory, based on the effective distributive friction factor.

20 Claims, 7 Drawing Sheets

(56) References Cited

U.S. PATENT DOCUMENTS

| | | | | |
|---|---|---|---|---|
| 2010/0307742 | A1 | 12/2010 | Phillips et al. | |
| 2011/0174541 | A1 | 7/2011 | Strachan et al. | |
| 2011/0214920 | A1 | 9/2011 | Vail, III et al. | |
| 2012/0291539 | A1 | 11/2012 | Schultz et al. | |
| 2012/0330551 | A1 | 12/2012 | Mitchell et al. | |
| 2013/0124165 | A1 | 5/2013 | Rubin et al. | |
| 2013/0213128 | A1 | 8/2013 | Gleitman | |
| 2013/0228381 | A1 | 9/2013 | Yambao et al. | |
| 2013/0277112 | A1 | 10/2013 | Edbury et al. | |
| 2014/0231141 | A1 | 8/2014 | Hay et al. | |
| 2015/0226025 | A1* | 8/2015 | Rios, III | E21B 33/038 166/75.14 |
| 2017/0009529 | A1* | 1/2017 | Oluwafemi | E21B 10/00 |

OTHER PUBLICATIONS

Oyedokun, O. and Schubert J, Extending the Reach of Coiled Tubing in Directional Wells With Downhole Motors, Mar. 25-26, 2014, 24 pages, SPE/ICoTA Coiled Tubing & Well Intervention Conference & Exhibition, SPE 168240, Society of Petroleum Engineers, The Woodlands, Texas, USA.

Edwin Felczak, Ariel Torre, Neil D. Godwin, Kate Mantle, Sivaraman Naganathan, Richard Hawkings, Ke Li, Stephen Jones, and Fred Slayden, The Best of Both Worlds—A Hybrid Rotary Steerable System, 2011/2012, 9 pages, http://www.slb.com/~/media/Files/resources/oilfield_review/ors11/win11/04_hybrid_rotary.pdf.

John Cameron, Refracturing horizontal shale wells with solid-steel expandable liners, World Oil, Aug. 2013, 7 pages, Gulf Publishing Co., USA.

Wilson C. Chin, Managed Pressure Drilling: Modeling Strategy and Planning, Jun. 6, 2011, 432 pages, Research Partnership to Secure Energy for America, Stratamagnetic Software, LLC, Final Report to RPSEA, Houston, TX.

* cited by examiner

OPTIMIZED COILED TUBING STRING DESIGN AND ANALYSIS FOR EXTENDED REACH DRILLING

CROSS-REFERENCE TO RELATED APPLICATIONS

This application is a U.S. national stage patent application of International Patent Application No. PCT/US2015/066014, filed on Dec. 16, 2015, the benefit of which is claimed and the disclosure of which is incorporated herein by reference in its entirety.

FIELD OF THE DISCLOSURE

The present disclosure relates generally to directional drilling operations using coiled tubing and, more particularly, to extending the reach of coiled tubing within subterranean formations during directional drilling operations.

BACKGROUND

To obtain hydrocarbons, such as oil and gas, boreholes are drilled by rotating a drill bit attached to the end of a drill string. Advances in drilling technology have led to the advent of directional drilling, which involves a drilling deviated or horizontal wellbore to increase the hydrocarbon production from subterranean formations. Modern directional drilling systems generally employ a drill string having a bottom-hole assembly (BHA) and a drill bit situated at an end thereof. The BHA and drill bit may be rotated by rotating the drill string from the surface, using a mud motor (i.e., downhole motor) arranged downhole near the drill bit, or a combination of the mud motor and rotation of the drill string from the surface. Pressurized drilling fluid, commonly referred to as "mud" or "drilling mud," is pumped into the drill pipe to cool the drill bit and flush cuttings and particulates back to the surface for processing. The mud may also be used to rotate the mud motor and thereby rotate the drill bit.

In some drilling systems, the drill string may be implemented using coiled tubing, typically composed of metal or some type of composite material. Advantages of using such coiled tubing strings include eliminating the need for conventional rigs and drilling equipment. However, the inability to rotate the tubing is one of the primary disadvantages of conventional coiled tubing strings, as this limits the reach of the string and deviated portion of the wellbore within the formation. Also, conventional coiled tubing strings are likely to buckle as the BHA penetrates the borehole deeper into the formation. Buckling is particularly acute in deviated wells where gravity does not assist in forcing the tubing downhole. Depending on the amount of deviation and the compression of the drill string, the drill string may take on a lateral or sinusoidal buckling mode. When the drill string is in the lateral bucking mode, further compression of the drill string may cause the drill string enters a helical buckling mode. The helical bucking mode may also be referred to as "corkscrewing."

Buckling may result in loss of efficiency in the drilling operation and premature failure of one or more drill string components. For example, as the tubing buckles, the torque and drag created by the contact with the borehole becomes more difficult to overcome and often makes it impractical or impossible to use coiled tubing to reach distant bypassed hydrocarbon zones. Further, steel coiled tubing often fatigues from cyclic bending early in the drilling process and must be replaced. In such cases, coiled tubing may be as expensive to use for extended reach drilling as a conventional drilling system with jointed steel pipe and a rig.

DESCRIPTION OF ILLUSTRATIVE EMBODIMENTS

Figure 1A:
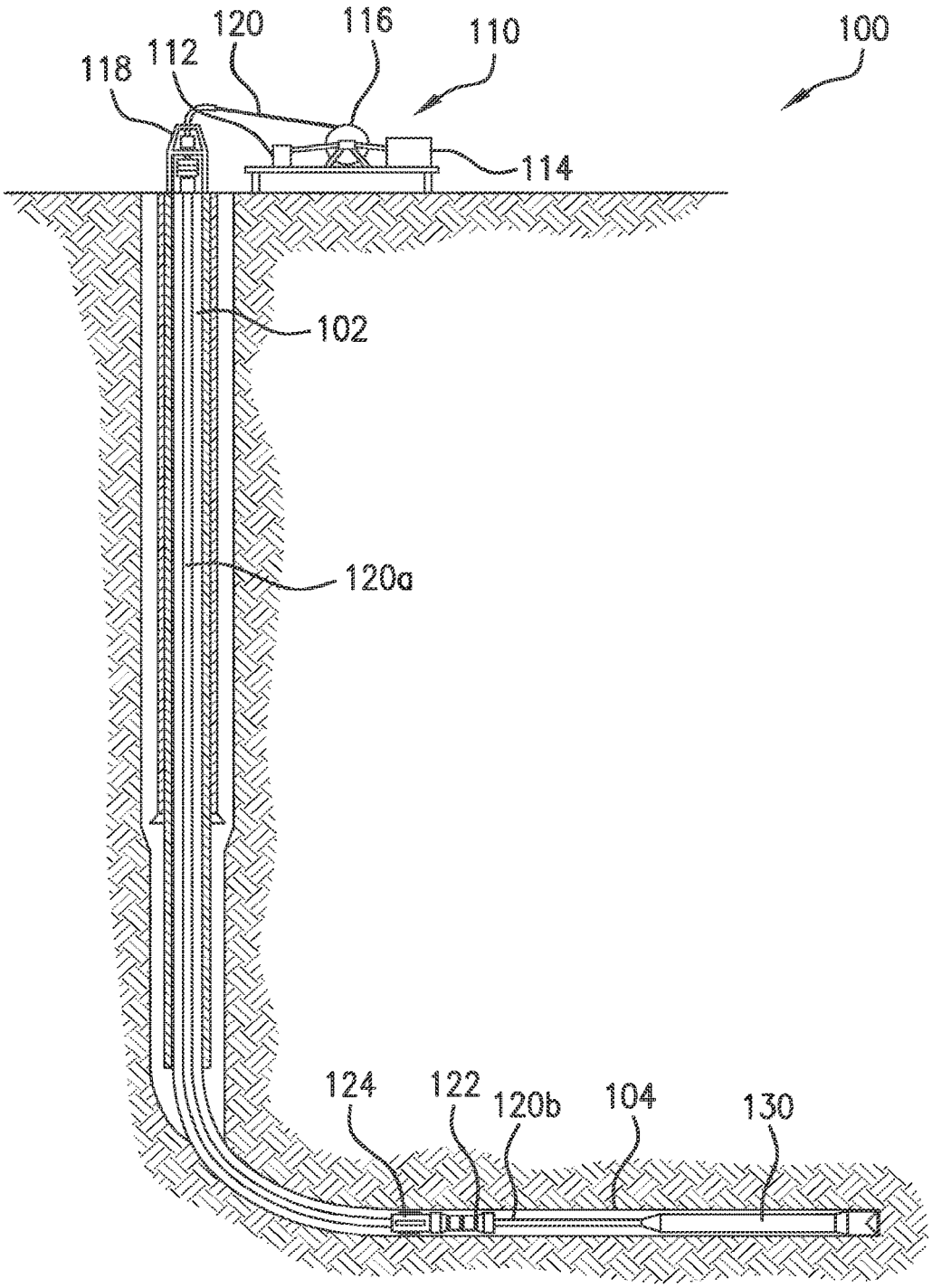
FIG. 1A is a diagram of an illustrative drilling system for drilling a deviated wellbore through a subsurface formation using a segmented coiled tubing string configuration with a downhole motor located upstream from the string's bottom hole assembly.

Embodiments of the present disclosure relate to optimizing the design and analysis of coiled tubing strings for drilling deviated wellbores within a subsurface formation. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

It would also be apparent to one of skill in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure, the downward direction being toward the bottom of the corresponding figure, the uphole and upstream directions being toward the surface of the wellbore, and the downhole and downstream directions being toward the toe of the wellbore. Likewise, the term "proximal" may be used herein to refer to the upstream or uphole direction with respect to a particular component of a drill string, and the term "distal" may be used herein to refer to the downstream or downhole direction with respect to a particular drill string component. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a figure may depict a horizontal wellbore or a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a figure may depict an onshore operation, it should be understood by those skilled in the art that the apparatus according to the present disclosure is equally well suited for use in offshore operations and vice-versa. Further, unless otherwise noted, even though a figure may depict a cased hole, it should be understood by those skilled in the art that the apparatus according to the present disclosure is equally well suited for use in open hole operations.

As will be described in further detail below, embodiments of the present disclosure may be used to optimize the design and analysis of a segmented coiled tubing string configured with a downhole motor located upstream from the string's bottom hole assembly for drilling a deviated wellbore within a subsurface formation. In one or more embodiments, the coiled tubing string may include a non-rotatable segment that extends from the surface of the wellbore to a proximal end of a downhole motor. The distal end of the downhole motor may be attached to a rotatable segment of the string that extends from the motor to a bottom hole assembly (BHA) attached to the end of the string. The BHA may include, for example, a rotary steerable tool and a drill bit for drilling the wellbore along a planned path through the subsurface formation in addition to various measurement-while-drilling (MWD) and/or logging-while-drilling (LWD) sensors for collecting different types of downhole data while the wellbore is drilled. In contrast with conventional drill string configurations in which the downhole motor is integrated within the BHA at the end of the string, the downhole motor of the coiled tubing string described herein is attached to the string as a separate component that is located upstream from the BHA and therefore, may be referred to herein as an "upstream downhole motor" or simply, "upstream motor." The use of such an upstream motor may also be more cost effective than using conventional articulated tractor technique for extended-reach drilling operations, as the rotation of a significant length of the string may significantly reduce the cuttings bed volume in the lateral section of the wellbore and thereby reduce operating costs allotted to the surface pump that is generally used in coiled tubing systems.

During the drilling operation, the upstream motor may be used to rotate the rotatable segment of the string including the drill bit at the very end of the string for purposes of drilling the wellbore through the subsurface formation. The rotational forces applied to the rotatable segment of the string by the motor may cause significant twisting of the non-rotatable segment of the string. Such twisting can destabilize the coiled tubing string and limit the reach of the string and wellbore within the subsurface formation. In some implementations, a stabilizer or twisting-restraining tool may be placed between the upstream motor and the non-rotatable segment to prevent or at least mitigate any twisting that may occur in this portion of the string. However, the non-rotatable segment of the string may still be subjected to high axial compressive forces, particularly in curved or tortuous sections of the wellbore path, which can lead to buckling that also limits the reach of the string during the drilling operation. Therefore, an effective design and implementation of such a coiled tubing string configuration should account for the drilling forces expected during a directional drilling operation so as to ensure that such forces remain within an optimal range over the course of the operation and thereby maximize the rate of penetration and reach of the string and wellbore within the formation.

Illustrative embodiments and related methodologies of the present disclosure are described below in reference to FIGS. 1A-6 as they might be employed, for example, in a computer system for well planning and analysis. For example, the disclosed techniques may be implemented as part of a comprehensive workflow provided by a well engineering application executable at the computer system for analyzing different sets of parameters related to the coiled tubing string configuration described above during the design and/or implementation phases of a directional drilling operation. Such a workflow may be used to optimize the configuration of the coiled tubing string as well as the different types of analysis that may be performed on the string configuration for a particular drilling operation. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

FIG. 1A is a diagram of an illustrative drilling system 100 for drilling a deviated wellbore through a subsurface formation using a segmented coiled tubing string configuration with a downhole motor located upstream from the string's bottom hole assembly. As shown in FIG. 1A, system 100 includes a coiled tubing control system 110 at the surface of a wellbore 102. Control system 110 includes a power supply 112, a surface processing unit 114, and a coiled tubing spool 116. An injector head unit 118 feeds and directs a drill string or coiled tubing string 120 from spool 116 into wellbore 102. Coiled tubing string 120 includes a non-rotatable segment 120*a* that extends from the surface of wellbore 102 to a proximal end of a downhole motor 122 and a twisting-restraining tool 124. The distal end of downhole motor 122 is attached to a rotatable segment 120*b* of string 120 within a horizontal or lateral section 104 of wellbore 102.

Downhole motor 122 may be, for example, a hydraulic motor (e.g., a mud motor) used to rotate rotatable segment 120*b* along with the drill bit attached to a BHA 130 at the very end of string 120 for purposes of drilling wellbore 102 through the subsurface formation. However, it should be appreciated that the disclosed embodiments are not limited to hydraulic motors and that other types of motors (e.g., electric motors) may be used instead. Twisting-restraining tool 124 may be, for example, a stabilizer or other drill string component for restraining non-rotatable segment 120*a* of coiled tubing string 120 to prevent or at least mitigate any twisting of this portion of the string due to the rotational forces applied by motor 122 during the drilling operation. As downhole motor 122 in this example is a separate component of string 120 that is located upstream of BHA 130, downhole motor 122 may be referred to as an "upstream motor," as described above.

In one or more embodiments, BHA 130 may include a drill bit and one or more downhole tools within a housing that may be moved axially within wellbore 102 as attached to coiled tubing string 120. Examples of such downhole tools may include, but are not limited to, a rotary steerable tool and one or more MWD and/or LWD tools for collecting downhole data related to formation characteristics and drilling conditions over different stages of the drilling operation. In some implementations, one or more force sensors (not shown) may be distributed along coiled tubing string 120 and BHA 130 for measuring physical force, strain, or material stress at different points along coiled tubing string 120 and BHA 130.

The data collected by such downhole tools and sensors may be transmitted to surface processing unit 114 via telemetry (e.g., mud pulse telemetry) or electrical signals transmitted via a wired or wireless connection between BHA 130 and surface processing unit 114, as will be described in further detail below. Surface processing unit 114 may be implemented using, for example, any type of computing device including at least one processor and a memory for storing data and instructions executable by the processor. Such a computing device may also include a network interface for exchanging information with a remote computing device via a communication network, e.g., a local-area or wide-area network, such as the Internet. An example of such a computing device will be described in further detail below with respect to FIG. 6.

Figure 1B:
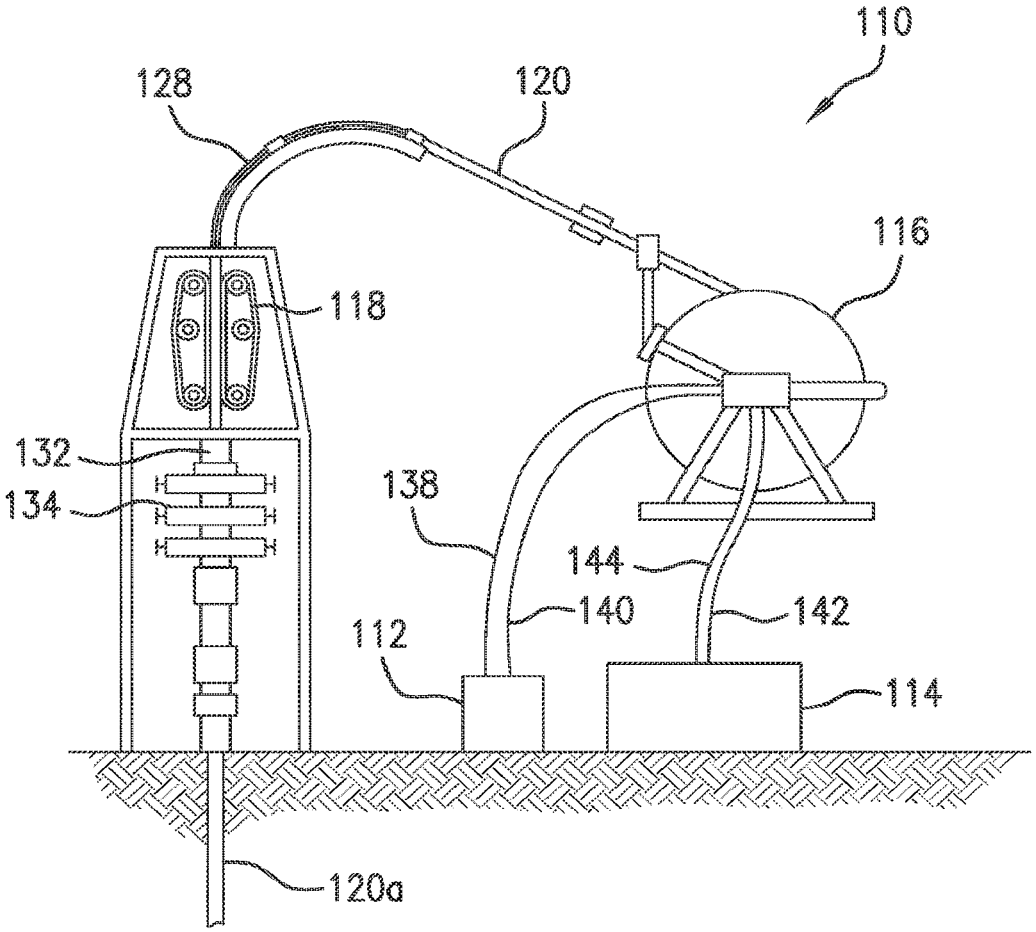
FIG. 1B is an enlarged view of a portion of the drilling system of FIG. 1A located at the surface of the wellbore.

FIG. 1B is an enlarged view of coiled tubing control system 110 of drilling system 100 shown in FIG. 1A, as described above. As shown in FIG. 1B, control system 110 includes a spool 116 for feeding coiled tubing string 120 over a guide 128 and through an injector 118 in line with a stripper 132. In operation, coiled tubing string 120 is forced by injector 118 through a blowout preventer 134 into the subsurface formation. A power supply 112 is electrically connected by electrical conduits 138 and 140 to corresponding electrical conduits in the wall of coiled tubing string 120.

Also, as shown in FIG. 1B, surface processing unit 114 includes communication conduits 142 and 144 that are connected to corresponding conduits housed in the wall of coiled tubing string 120. It should be appreciated that while only power conduits 138, 140 and communication conduits 142, 144 are shown in FIG. 1B, any number of power conduits and/or communication conduits may be used as desired for a particular implementation. It should also be appreciated that power conduits 138, 140 and communication conduits 142, 144 may extend along the entire length of coiled tubing string 120.

Referring back to FIG. 1A, power conduits 138, 140 and communication conduits 142, 144 in some implementations may also be connected to downhole motor 122 and BHA 130 or component thereof. In one or more embodiments, communication conduits 142 and 144 may be used to transfer data and communication signals between surface processing unit 114 and BHA 130 or component(s) thereof. For example, communication conduits 142 and 144 may be used to transfer downhole measurements collected by MWD and/or LWD components of BHA 130 to surface processing unit 114. Additionally, surface processing unit 114 may use conduits 142 and 144 to send control signals to BHA 130 for controlling the operation of BHA 130 or individual components thereof. In this way, surface processing unit 114 may implement different kinds of functionality, e.g., adjusting the planned trajectory of the wellbore, during different stages of the drilling operation. Similarly, surface processing unit 114 may use conduits 142 and 144 to send control signals for controlling the operation of downhole motor 122 during the drilling operation.

In one or more embodiments, surface processing unit 114 may provide an interface enabling a drilling operator at the surface to adjust various drilling parameters to control the drilling operation as different sections of wellbore 102 are drilled through the subsurface formation. The interface may include a display for presenting relevant information, e.g., values of drilling parameters, to the operator during the drilling operation as well as a user input device (e.g., a mouse, keyboard, touch-screen, etc.) for receiving input from the operator. As downhole operating conditions may continually change over the course of the operation, the operator may use the interface provided by surface processing unit 114 to react to such changes in real time and adjust various drilling parameters from the surface in order to optimize the drilling operation. Examples of drilling parameters that may be adjusted include, but are not limited to, weight on bit, drilling fluid flow through the drill pipe, the drill string rotational speed, and the density and viscosity of the drilling fluid.

As described above, the rotational forces applied to the rotatable segment of a coiled tubing string, such as string 120, by an upstream downhole motor may cause significant twisting of the non-rotatable segment of the string. Conventional wellbore analysis techniques are generally designed to implement and analyze directional drilling operations using conventional coiled-tubing or jointed-pipe strings. However, an effective design and implementation of a directional drilling operation using the segmented coiled tubing string configuration described herein should account for the types of forces that may be imposed on different segments of the string during the drilling operation, as shown in FIGS. 2A and 2B.

Figure 2A:
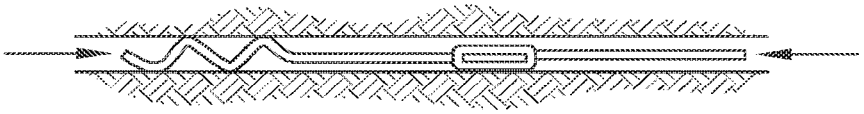
FIG. 2A is a schematic view of a segmented coiled tubing string for which frictional forces induced by an upstream downhole motor are shown for different segments of the string.
Figure 2B:
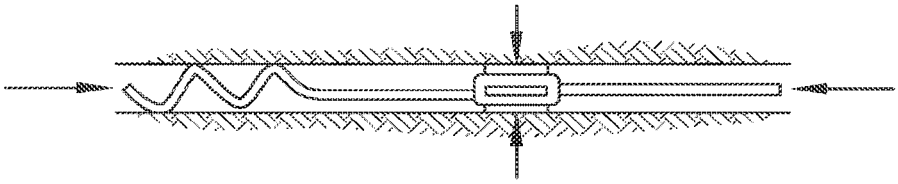
FIG. 2B is a schematic view of another segmented coiled tubing string for which frictional forces induced by an upstream downhole motor with a twisting-restraining tool are shown for different segments of the string.

FIG. 2A is a schematic view of a portion of a segmented coiled tubing string that illustrates the various axial forces that may be induced by such an upstream downhole motor. FIG. 2B is a schematic view of the portion of the segmented coiled tubing string shown in FIG. 2A, which shows the additional friction that may be induced by a twisting-restraining tool, such as twisting-restraining tool 124 of FIG. 1A. To obtain the same force boundary conditions as in FIG. 2A, i.e., where no twisting-restraining tool is used, the additional frictional drag forces may be distributed over a selected length of the non-rotatable segment of the string.

In one or more embodiments, inversion techniques may be used to estimate an effective-distributive friction factor representing the distribution of frictional forces for any cumulative length of the non-rotatable segment of the string. The primary aim of the techniques that are used may be to ensure that the force boundary conditions estimated for starting and ending points of the non-rotatable segment of a string design are representative of the real-world conditions that may be expected during the actual drilling operation.

The value of the effective-distributive friction factor may depend on, for example, the length of the non-rotatable segment of the string. In one or more embodiments, the length of the non-rotatable segment may be constrained to a predetermined length of the string over which the frictional forces are to be distributed. The length of the non-rotatable string segment may be based on, for example, physical properties of this segment of the string. Examples of such physical properties include, but are not limited to, the torsional yield strength of the tubing material associated with this section of the string and the weight of the string. Other factors that may constrain the length of the non-rotatable segment in the string design may include the planned trajectory of the wellbore (or tortuosity thereof) and the viscosity of the drilling fluid that may be used during the drilling operation.

The effective-distributive friction factor for different portions of a particular string configuration may be expressed using Equation (1) as follows:

$$\frac{dF_t}{dx_j} - \left[\sum_{k=1}^{r} \mu_k \xi_k w_{c,k}\right]_j + w_p \cos\varphi_j \tag{1}$$

where $\xi_k$ is a Boolean parameter that defines the string configuration for the non-rotatable segment of the string along a particular section of the wellbore; k is an index defining the tubing configuration; j is an index defining the section of the wellbore for which an effective distributive friction factor may be applied to a corresponding portion of the non-rotatable string segment; $w_{c,k}$ is the wall contact force acting on the string; $w_p \cos \varphi_j$ is the string weight component in the axial direction; and $F_t$ is the axial force in the string.

In one or more embodiments, the effective-distributive friction factor may be estimated for the non-rotatable segment of the coiled tubing string as part of a workflow for developing an overall well plan for a directional drilling operation. As will be described in further detail below with respect to FIGS. 3-5, such a workflow may involve performing different types of analyses, including, but not limited to, a torque and drag analysis and a hydraulics analysis, for the non-rotatable and rotatable segments of the coiled tubing string configuration.

In one or more embodiments, the steps of the workflow may be implemented as part of the functionality provided by a well engineering application executable at a computing device of a user (e.g., drilling engineer). The computing device may be implemented using any type of computing device having at least one processor and a processor-readable storage medium for storing data and instructions executable by the processor. As will be described in further detail below with respect to FIG. 6, such a computing device may also include an input/output (I/O) interface for receiving user input or commands via a user input device, e.g., a mouse, a QWERTY or T9 keyboard, a touch-screen, a graphics tablet, or a microphone. The I/O interface also may be used by each computing device to output or present information to a user via an output device. The output device may be, for example, a display coupled to or integrated with the computing device for displaying various types of information, including information related to the torque and drag and hydraulics analyses described herein.

Figure 3:
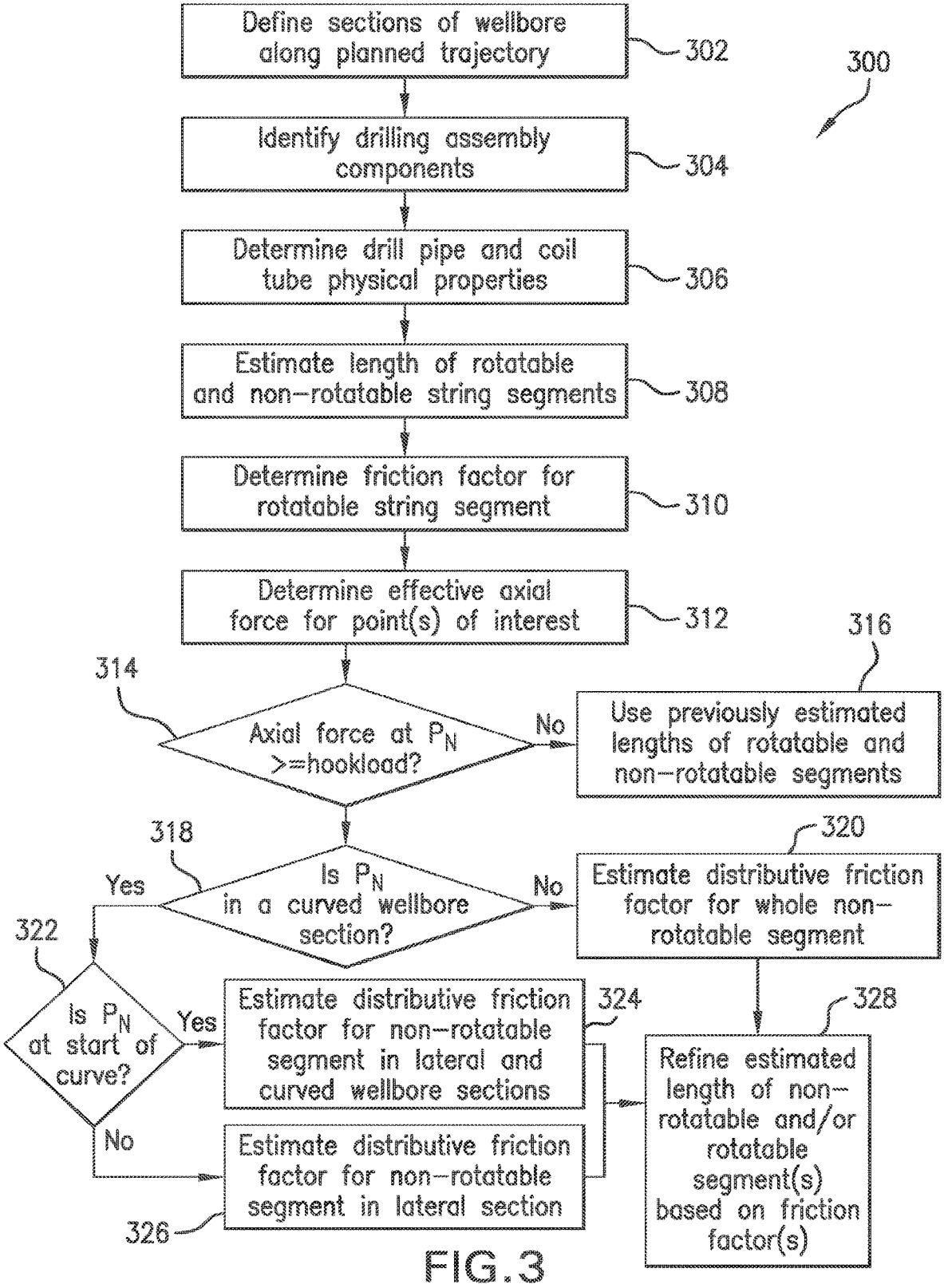
FIG. 3 is a flowchart of an illustrative process for estimating a distributive friction factor for different segments of a coiled tubing string configuration along different sections of a planned wellbore to be drilled within a subsurface formation.

FIG. 3 is a flowchart of an illustrative process 300 for estimating an effective-distributive friction factor for one or more segments of a coiled tubing string configuration along different sections of a deviated wellbore to be drilled along a planned trajectory within a subsurface formation. For discussion purposes, process 300 will be described using drilling system 100 of FIGS. 1A and 1B, as described above. However, process 300 is not intended to be limited thereto. For example, the coiled tubing string configuration for which the effective-distributive friction factor is estimated may be coiled tubing string 120 of FIGS. 1A and 1B, as described above. As described above, the deviated wellbore in this example may be drilled using an upstream downhole motor (e.g., downhole motor 122 of FIG. 1A, as described above), which rotates a drill bit of a BHA attached to the end of a rotatable segment of the coiled tubing string. The rotatable segment of the string may be attached to a distal end of the downhole motor while a non-rotatable segment extending from the surface of the wellbore is attached to a proximal end of the motor.

As shown in FIG. 3, process 300 begins in step 302, which includes defining a plurality of sections for the planned wellbore trajectory to be drilled within the subsurface formation. The sections that may be defined in step 302 may include, for example, vertical, curved, and lateral sections of the planned wellbore trajectory. As will be described in further detail below, the effective-distributive friction factor estimated using process 300 may be used to refine a previously estimated length of the rotatable and/or non-rotatable segments of the string for one or more of these sections of the planned wellbore trajectory, e.g., as part of the overall well plan being developed for the directional drilling operation in this example.

In step 304, components of the coiled tubing string associated with each of the non-rotatable and rotatable segments are identified. The components that may be identified for the non-rotatable segment may include, for example and without limitation, one or more stabilizers or twisting-restraining tool(s) (e.g., twisting-restraining tool 124 of FIG. 1A, as described above). The physical or mechanical properties of the non-rotatable and rotatable string segments along the wellbore trajectory are then determined in step 306. In step 308, a length of the rotatable segment of the string along one or more sections of the wellbore may be estimated, based on the corresponding properties of the rotatable segment within one or more wellbore sections. Similarly, the length of the non-rotatable segment may be estimated based on the corresponding properties of the non-rotatable segment within one or more wellbore sections.

In one or more embodiments, the length of the rotatable segment of the string may be estimated using a three-dimensional (3D) torque and drag model, e.g., as expressed by Equation (2):

$$l_R = \frac{M_t - \mu_j r_p \int_{\beta^*}^{\beta^{}} w_c R d\beta - M_{bit} - \mu_j \sin\varphi \sum_{i=1}^{k} w_{p,i} l_i r_{p,i}}{\mu_j r_p w_p \sin\varphi} + R(\beta^{} - \beta^*) + \sum_{i=1}^{k} l_i \quad (2)$$

where β* and β** may represent curved sections of the wellbore trajectory, e.g., in the form of dog legs, within the subsurface formation. The estimated length may exclude the portions of the rotatable segment corresponding to the downhole motor and the BHA.

In the above torque and drag model according to Equation (2), it is assumed that no surface pump constraints are imposed on the downhole coiled tubing string, e.g., as in drilling system 100 of FIGS. 1A and 1B, as described above. However, a different model may be used to estimate the rotatable length of the coiled tubing string when constraints are imposed on the string by a surface pump, as shown in the example of FIG. 4.

Figure 4:
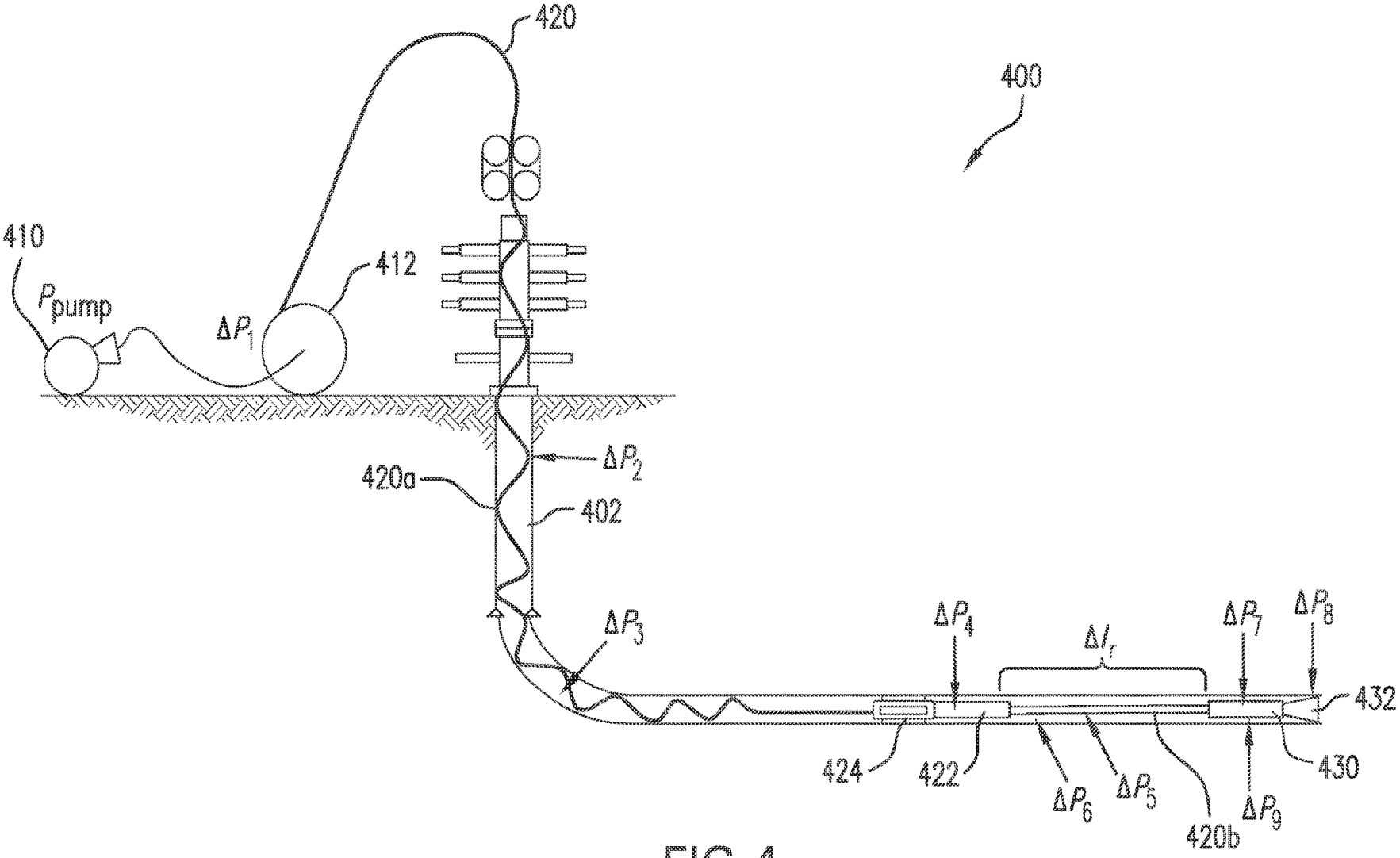
FIG. 4 is a schematic view of an illustrative drilling system including a segmented coiled tubing string with a downhole motor located upstream from the string's bottom hole assembly for drilling a deviated wellbore through a subsurface formation.

FIG. 4 is a schematic view of an illustrative drilling system 400 including a surface pump coupled to a segmented coiled tubing string configuration with a downhole motor 422 located upstream from the BHA for drilling a deviated wellbore through a subsurface formation. As shown in FIG. 4, a surface pump 410 may be used to pump or inject pressurized drilling fluid, e.g., drilling mud, into a wellbore 402 via a coiled tubing string 420 fed from a spool 412 at the surface of the wellbore. While not shown in FIG. 4, it should be appreciated that spool 412 may be part of a coiled tubing control system that includes a power supply and a surface processing unit, e.g., similar to control system 110 of FIGS. 1A and 1B, as described above. The drilling fluid may be used, for example, to cool a drill bit 432 attached to the end of a BHA 430 as well as to flush cuttings and particulates back to the surface during the drilling operation. In some implementations, downhole motor 422 may be a hydraulic motor (e.g., a mud motor) and the drilling fluid (e.g., mud) may also be used to rotate the motor and thereby rotate drill bit 432.

Similar to coiled tubing string 120 of drilling system 100 of FIGS. 1A and 1B, described above, coiled tubing string 420 includes a non-rotatable segment 420*a* that extends from the surface of wellbore 402 and attaches to a proximal end of downhole motor 422 and a twisting-restraining tool 424. The distal end of downhole motor 422 is attached to a rotatable segment 420*b* of string 420, which is located within a horizontal or lateral section of wellbore 402 in this example. In contrast with drilling system 100 of FIGS. 1A and 1B, the use of surface pump 410 in system 400 may impose constraints on coiled tubing string 420 within wellbore 402.

For example, the pressurized fluid injection capability or discharge capacity of surface pump 410 may constrain the length of rotatable segment 420*b* during the drilling operation. In one or more embodiments, the amount of pressure change (ΔP) may be estimated for different points of interest along the length of coiled tubing string 420. In the example as shown in FIG. 4, $\Delta P_4$ may represent the pressure drop at downhole motor 422 while $\Delta P_5$ and $\Delta P_6$ may represent pressure drops in the drill pipe/tubing and annulus, respectively, corresponding to rotatable segment 420*b*. Accordingly, the pressure drop $\Delta P_L$ along coiled tubing string 420, excluding downhole motor 422 and rotatable string segment 420*b*, may be expressed as the sum of the pressure drop values at the remaining points of interest along the length of coiled tubing string 420, as expressed by Equation (3):

$$\Delta P_1+\Delta P_2+\Delta P_3+\Delta P_7+\Delta P_8+\Delta P_9=\Delta P_L \quad (3).$$

In one or more embodiments, the constrained length and/or other dimensions of the rotatable string segment may be estimated based on an optimization technique that accounts for such surface constraints on the string configuration at different points within wellbore 402. Such an optimization technique may be based on, for example, a Pareto optimization or Lagrange multiplier. The objectives of the optimization may include maximizing the total measured depth ($l_{md}$), maximizing the total length ($l_r$) of rotatable segment 420*b*, and minimizing the pressure drop within rotatable segment 420*b* of coiled tubing string 420, as expressed by Equations (4), (5), and (6), respectively:

$$\text{Maximize: } l_{md}=\Sigma_{j=1}^{t} l_j \quad (4)$$

$$\text{Maximize: } \Delta l_r=f(\Delta P_4, \vec{\chi}) \quad (5)$$

$$\text{Minimize: } \Delta P_5=f(\Delta l_r, \vec{\psi}) \quad (6)$$

where $\vec{\chi}$ and $\vec{\psi}$ are vectors of parameters affecting the rotating length estimation which can be optimized in the process of determining constrained optimum value of the length. As used herein, the term "measured depth" may refer to a depth of the string that is estimated or expected to be measured for one or more sections of the wellbore once it is actually drilled along its planned trajectory within the subsurface formation.

The constraints for the above-described optimization technique may be expressed by Equations (7), (8), and (9) as follows:

$$P_{pump}=\Sigma_{j=1}^{9}\Delta P_j \quad (7)$$

$$\sigma_{MSE}<\sigma_Y \quad (8)$$

$$F_0=\zeta \quad (9)$$

where $P_{pump}$ is the pumping pressure, $\sigma_{MSE}$ is the mechanical specific energy of the string, $\sigma_y$ is the string's yield strength, $F_0$ is the force applied to a top portion or proximal end of the string's downhole assembly or BHA within the subsurface formation, ζ is the force applied at a bottom portion or distal end of the string's downhole assembly or BHA within the subsurface formation.

Referring back to FIG. 3, once the length of the rotatable segment is estimated in step 308, e.g., using either the torque and drag model or the optimization technique as described above, process 300 then proceeds to step 310, which includes calculating a friction factor for the rotatable segment based on the estimated length. In step 312, an effective axial force may be estimated for one or more points of interest along the non-rotatable and rotatable segments of the drill string, based in part on the friction factor calculated for the rotatable segment in step 310.

Process 300 then proceeds to step 314, which includes determining whether or not the effective axial force estimated in step 312 for at least one point of interest exceeds a predetermined maximum hook load threshold. If it is determined that there are no points of interest for which the effective axial force exceeds the predetermined maximum hook load threshold, process 300 proceeds to step 316, in which the previously estimated length of the rotatable string segment (from step 308) for one or more sections of the wellbore trajectory is used for the coiled tubing string design. However, if the effective axial force for at least one point of interest is determined to exceed the predetermined maximum hook load threshold, process 300 proceeds to step 318, which includes determining whether or not the particular point of interest is within or corresponds to a curved section of the wellbore.

If it is determined in step 318 that the point of interest does not to correspond to a curved wellbore section, process 300 proceeds to step 320, which includes estimating the effective-distributive friction factor for the entire non-rotatable segment of the drill string, including for portions of the non-rotatable segment within the vertical, curved, and/or lateral sections of the planned wellbore trajectory. However, if the point of interest is determined to correspond to a curved wellbore section, process 300 proceeds to step 322, which includes determining whether or not the point of interest is located on a part of the non-rotatable string segment at or near the start of the curved section.

If the particular point of interest is determined in step 322 to be located at or near the start of the curved section, process 300 proceeds to step 324, which includes estimating the effective-distributive friction factor for a portion of the non-rotatable segment corresponding to the curved and lateral sections of the planned wellbore trajectory. Otherwise, it may be assumed that the point is located on a part of the non-rotatable string segment at or near the end of the curved section and process 300 proceeds to step 326, which includes estimating the effective-distributive friction factor for a portion of the non-rotatable segment corresponding to only the lateral section of the planned wellbore trajectory. The effective-distributive friction factor that is estimated for the portion(s) of the non-rotatable segment in either of steps 320 or 326 may then be used in step 328 to refine the length of the non-rotatable segment as previously estimated (in step 308) for one or more sections of the planned wellbore trajectory. In one or more embodiments, the refined length of the non-rotatable segment may also be used to refine the previously estimated length of the rotatable segment of the string.

In one or more embodiments, the steps of process 300, including the estimation of the effective-distributive friction factor for the non-rotatable string segment as described above, may be part of a torque and drag analysis of the string configuration. The distributive friction factors resulting from the torque and drag analysis may then be incorporated into a hydraulics analysis for the string configuration. The hydraulics analysis may include, for example, analyzing the effect of rotating a portion of the coiled tubing string (e.g., rotatable segment 420*b* of string 420 of FIG. 4, as described above) on the fluid flow characteristics expected for one or more sections of the wellbore along its planned trajectory through the subsurface formation.

In one or more embodiments, such an analysis may involve adjusting a plastic viscosity parameter of a drilling fluid to be used with the particular coiled tubing string configuration. The plastic viscosity parameter may be adjusted according to, for example, Equation (10):

$$K_2 = K_1\left[\frac{(\dot{\gamma}_1 + \Delta\dot{\gamma})^n}{(\dot{\gamma}_1)^n}\right] \tag{10}$$

where K2 is the resultant plastic viscosity due to the rotation of the rotatable segment of the string, K1 is the initial plastic viscosity, and $\Delta\dot{\gamma}$ is the shear rate of deformation of the fluid as a result of the rotation of the string segment. In addition to adjusting the plastic viscosity parameter using Equation (10), the hydraulic analysis may include adjusting or calibrating operating parameters of the string configuration that may impact the fluid flow along the planned wellbore trajectory, as will be described in further detail below with respect to FIG. 5.

Figure 5:
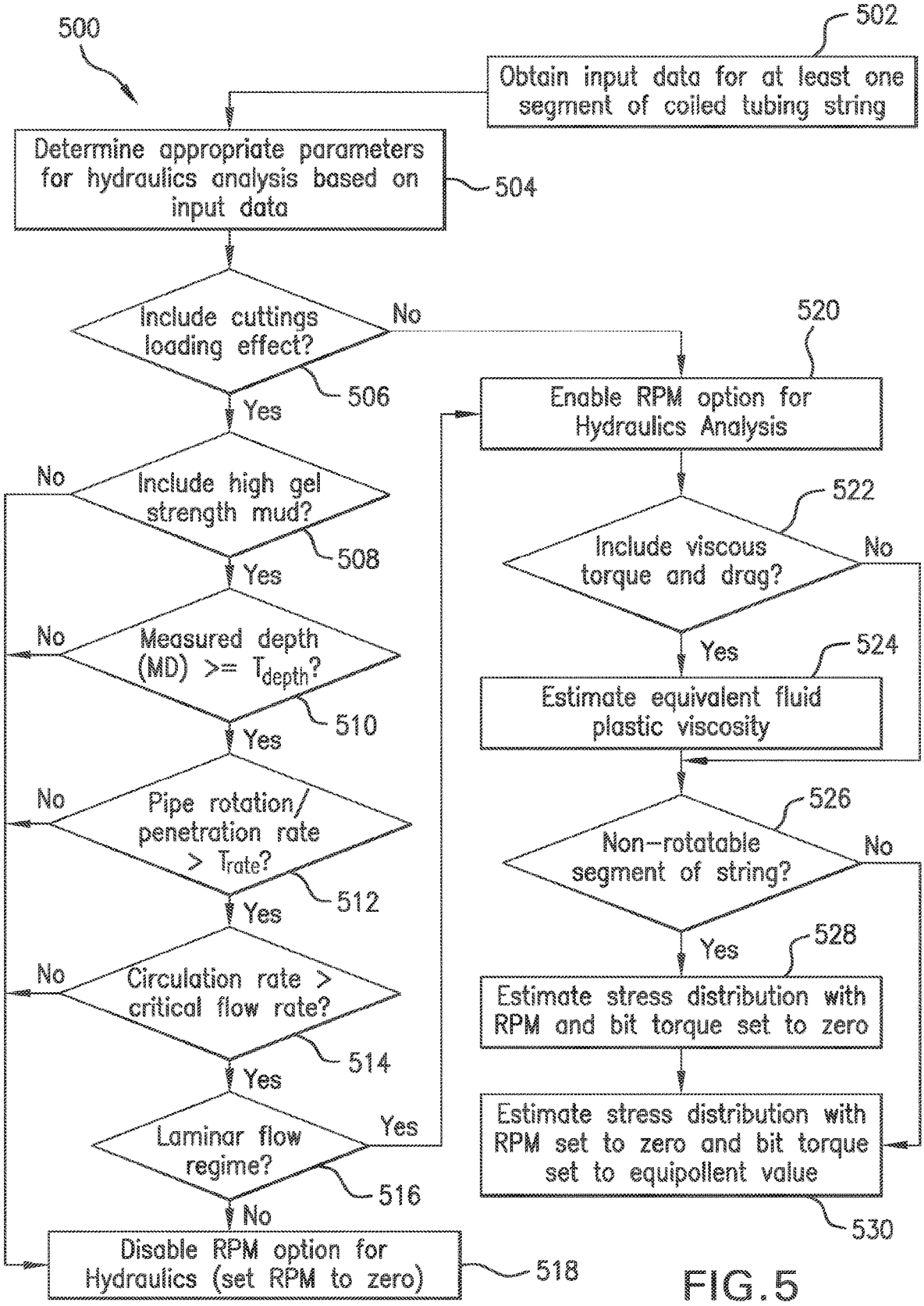
FIG. 5 is a flowchart of an illustrative process for analyzing the effect of a segmented coiled tubing string configuration on fluid flow characteristics in one or more sections of the planned wellbore of FIG. 3.

FIG. 5 is a flowchart of an illustrative process 500 for analyzing the effect of a segmented coiled tubing string configuration on fluid flow characteristics in one or more sections of the planned wellbore of FIG. 3, as described above. For discussion purposes, process 500 will be described using drilling system 100 of FIGS. 1A and 1B, as described above. However, process 500 is not intended to be limited thereto. Also, for discussion purposes, process 500 will be described using drilling system 400 of FIG. 4, as described above, but is not intended to be limited thereto. For example, the coiled tubing string configuration may be implemented using either string 120 of FIGS. 1A and 1B or string 420 of FIG. 4, as described above.

Process 500 begins in step 502, which includes obtaining input data for initiating the hydraulics analysis for at least one segment of the coiled tubing string. The input data may include, for example, data related to the properties of the subsurface formation in which one or more sections of the wellbore are to be drilled along with the properties of the drilling fluid associated with the well plan. Additionally, the input data may include operating parameters associated with the drilling operation including, but not limited to, the rotation rate or rotary speed of the rotatable segment of the tubing string, e.g., as measured in revolutions per minute (RPM), which may initially be set to a value of zero. The input data may further include the pump rate and other parameters that may be relevant to the particular type of fluid to be used for drilling.

Process 500 then proceeds to step 504, which includes determining appropriate parameters for the hydraulics analysis based on the input data. In addition to the fluid plastic viscosity parameter described above, examples of other parameters that may be considered for the hydraulics analysis include, but are not limited to, cuttings loading effect, mud type, measured depth, pipe rotation or penetration rate, circulation rate, and type of flow regime. As illustrated in the example of FIG. 5, step 504 may be performed as a series of decisions regarding whether or not such parameters are to be included in the hydraulics analysis, as will be described in further detail below with respect to steps 506, 508, 510, 512, 514 and 516 of process 500.

In one or more embodiments, such decisions may be made based on input from a user of a well engineering application executable at the user's computing device, as described above. For example, the steps of process 500 may be implemented as part of the functionality provided to the user by the well engineering application. In one or more embodiments, the user may access such functionality via a graphical user interface (GUI) of the well engineering application. The user may interact with the GUI to specify various options corresponding to the parameters of interest for the torque and drag analysis described above with respect to process 300 of FIG. 3 as well as the hydraulics analysis based on process 500. In some implementations, the parameters associated with each type of analysis may be displayed as user-selectable options within a corresponding settings panel or other dedicated window or area of the GUI for providing user control options for each type of analysis to be performed for the string configuration in this example.

In one or more embodiments, the inclusion or exclusion of certain parameters may be used to determine whether or not the rotation rate/rotary speed (or RPM) of the string should be included in the hydraulics analysis, e.g., whether or not to automatically, without user intervention, disable (step 518) or enable (step 520) an RPM option within a hydraulics analysis settings panel of the GUI provided by the well engineering application, as will be described in further detail below.

For example, step 506 may include determining whether or not to include the effect of a cuttings loading parameter in the hydraulics analysis. If the cuttings loading effect is determined not to be included (e.g., the user has disabled this option for the hydraulics analysis), process 500 proceeds directly to step 520, in which the string's rotation rate/rotary speed (or RPM) is taken into account for the hydraulics analysis, e.g., by automatically enabling the RPM option in the hydraulics settings panel of the as described above. Otherwise, process 500 proceeds to step 508, which includes determining whether or not the drilling fluid under analysis is a high gel strength mud. If the fluid is determined not to be a high gel strength mud, process 500 proceeds directly to step 518, in which the string's rotation rate (or RPM) is excluded from the hydraulics analysis, e.g., by automatically disabling the RPM option in the hydraulics settings panel as described above or setting the string's rotation rate to a value of zero. Otherwise, process 500 proceeds to step 510, which includes determining whether or not a "measured" depth (MD), which may be an estimated depth of the string or value of the depth expected to be measured within the subsurface formation, is greater than or equal to a predetermined threshold depth ($T_{depth}$). The estimated depth of the wellbore trajectory may be based on, for example, a length of the rotatable segment of the coiled tubing string, e.g., as estimated in step 308 of process 300 of FIG. 3, as described above.

If it is determined in step 510 that such a measured depth is less than the predetermined threshold depth, process 500 proceeds directly to step 518 and the string's RPM is excluded from the hydraulics analysis as described above. However, if the measured depth is determined to be greater than or equal to the predetermined threshold, process 500 proceeds to step 512, which includes determining whether or not a pipe rotation/penetration rate exceeds a predetermined threshold rate ($T_{rate}$).

If it is determined in step 512 that the pipe rotation/penetration rate does not exceed the predetermined threshold rate, process 500 proceeds directly to step 518 as before. Otherwise, process 500 proceeds to step 514, which includes determining whether or not a circulation rate of the drilling fluid exceeds a predetermined critical flow rate. If it is determined in step 514 that the fluid's circulation rate does not exceed the predetermined critical flow rate, process 500 proceeds directly to step 518. Otherwise, process 500 proceeds to step 516, which includes determining whether or not the type of flow regime associated with the fluid is a laminar flow regime.

If it is determined in step 516 that the type of flow regime is not laminar flow, process 500 proceeds to step 518, after which process 500 ends. Otherwise, process 500 proceeds to step 520, in which the string's rotation rate (or RPM) is taken into account, e.g., RPM option is enabled and set to a specified value, for the hydraulics analysis, as described above. Process 500 then continues to step 522, which includes determining whether or not to include viscous torque and drag as part of the hydraulics analysis.

If it is determined in step 522 that viscous torque and drag is to be included in the hydraulics analysis, process 500 proceeds to step 524, which includes estimating an equivalent fluid plastic viscosity. Otherwise, process 500 proceeds to step 526, which includes determining whether or not the particular segment of the coiled tubing string that is currently under analysis is a non-rotatable segment of the string.

If it is determined in step 526 that the current segment is a non-rotatable segment of the string, process 500 proceeds to step 528, which includes estimating or calculating the stress distribution for the non-rotatable segment with the string's rotation rate or RPM and bit torque set to values of zero. However, if it is determined that the current segment is a rotatable segment of the string, process 500 proceeds to step 530, which includes estimating the stress distribution for the rotatable segment with the string's RPM set to zero and the bit torque set to an equipollent value. In one or more embodiments, the torque and string rotary speed may be implemented as separate modules within the above-described well engineering application, where the modules may provide corresponding sets of input options for the hydraulics analysis in different areas of the application's GUI.

Figure 6:
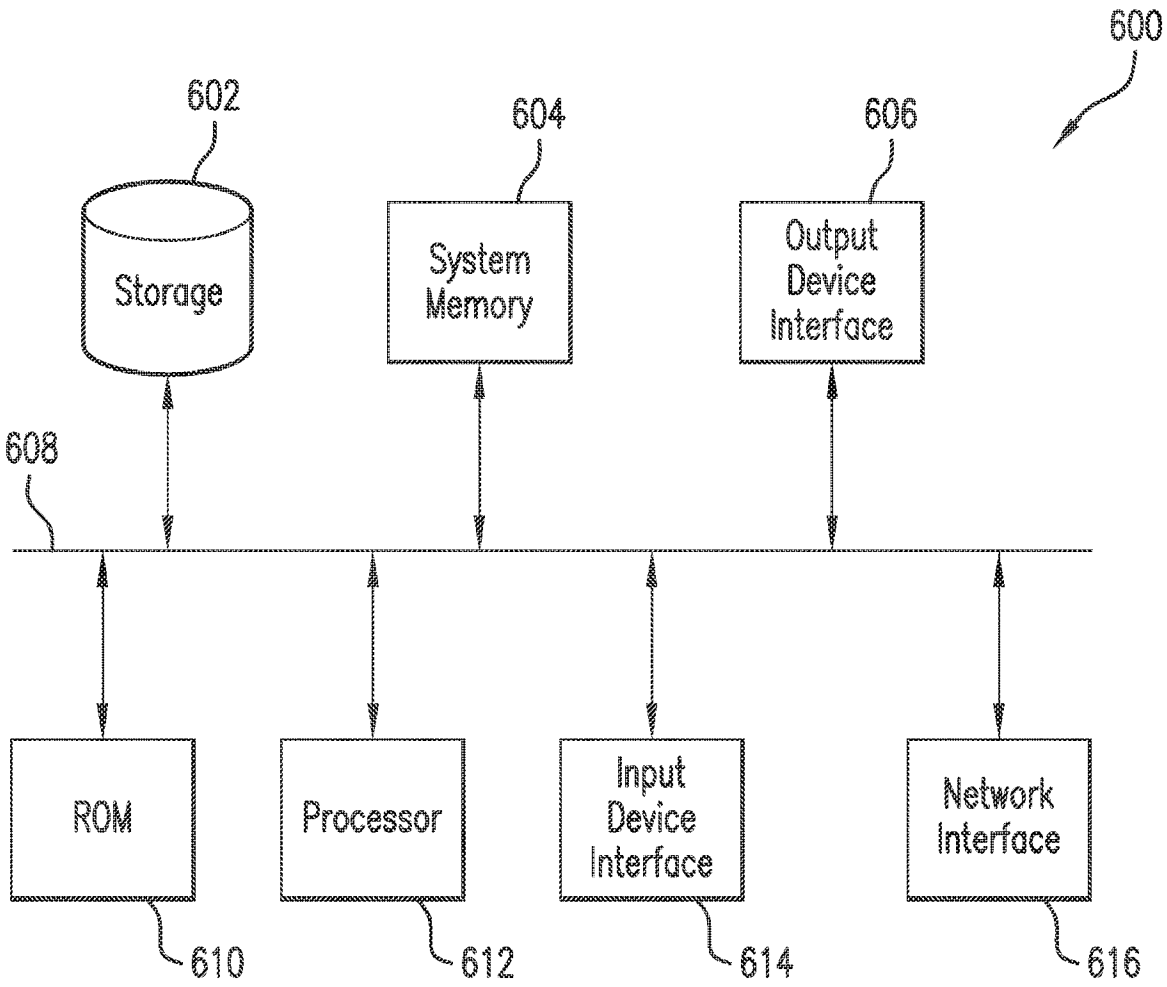
FIG. 6 is a block diagram of an illustrative computer system in which embodiments of the present disclosure may be implemented.

FIG. 6 is a block diagram of an illustrative computer system 600 in which embodiments of the present disclosure may be implemented. For example, the steps of processes 300 and 500 of FIGS. 3 and 5, respectively, as described above, may be performed by system 600. Further, system 600 may be used to implement, for example, surface processing unit 114 of FIGS. 1A and 1B, as described above. System 600 can be any type of electronic computing device or cluster of such devices, e.g., as in a server farm. Examples of such a computing device include, but are not limited to, a server, workstation or desktop computer, a laptop computer, a tablet computer, a mobile phone, a personal digital assistant (PDA), a set-top box, or similar type of computing device. Such an electronic device includes various types of computer readable media and interfaces for various other types of computer readable media. As shown in FIG. 6, system 600 includes a permanent storage device 602, a system memory 604, an output device interface 606, a system communications bus 608, a read-only memory (ROM) 610, processing unit(s) 612, an input device interface 614, and a network interface 616.

Bus 608 collectively represents all system, peripheral, and chipset buses that communicatively connect the numerous internal devices of system 600. For instance, bus 608 communicatively connects processing unit(s) 612 with ROM 610, system memory 604, and permanent storage device 602.

From these various memory units, processing unit(s) 612 retrieves instructions to execute and data to process in order to execute the processes of the subject disclosure. The processing unit(s) can be a single processor or a multi-core processor in different implementations.

ROM 610 stores static data and instructions that are needed by processing unit(s) 612 and other modules of system 600. Permanent storage device 602, on the other hand, is a read-and-write memory device. This device is a non-volatile memory unit that stores instructions and data even when system 600 is off. Some implementations of the subject disclosure use a mass-storage device (such as a magnetic or optical disk and its corresponding disk drive) as permanent storage device 602.

Other implementations use a removable storage device (such as a floppy disk, flash drive, and its corresponding disk drive) as permanent storage device 602. Like permanent storage device 602, system memory 604 is a read-and-write memory device. However, unlike storage device 602, system memory 604 is a volatile read-and-write memory, such a random access memory. System memory 604 stores some of the instructions and data that the processor needs at runtime. In some implementations, the processes of the subject disclosure are stored in system memory 604, permanent storage device 602, and/or ROM 610. For example, the various memory units include instructions for computer aided pipe string design based on existing string designs in accordance with some implementations. From these various memory units, processing unit(s) 612 retrieves instructions to execute and data to process in order to execute the processes of some implementations.

Bus 608 also connects to input and output device interfaces 614 and 606. Input device interface 614 enables the user to communicate information and select commands to the system 600. Input devices used with input device interface 614 include, for example, alphanumeric, QWERTY, or T9 keyboards, microphones, and pointing devices (also called "cursor control devices"). Output device interfaces 606 enables, for example, the display of images generated by the system 600. Output devices used with output device interface 606 include, for example, printers and display devices, such as cathode ray tubes (CRT) or liquid crystal displays (LCD). Some implementations include devices such as a touchscreen that functions as both input and output devices. It should be appreciated that embodiments of the present disclosure may be implemented using a computer including any of various types of input and output devices for enabling interaction with a user. Such interaction may include feedback to or from the user in different forms of sensory feedback including, but not limited to, visual feedback, auditory feedback, or tactile feedback. Further, input from the user can be received in any form including, but not limited to, acoustic, speech, or tactile input. Additionally, interaction with the user may include transmitting and receiving different types of information, e.g., in the form of documents, to and from the user via the above-described interfaces.

Also, as shown in FIG. 6, bus 608 also couples system 600 to a public or private network (not shown) or combination of networks through a network interface 616. Such a network may include, for example, a local area network ("LAN"), such as an Intranet, or a wide area network ("WAN"), such as the Internet. Any or all components of system 600 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself. Accordingly, the steps of processes 400 and 500 of FIGS. 4 and 5, respectively, as described above, may be implemented using system 600 or any computer system having processing circuitry or a computer program product including instructions stored therein, which, when executed by at least one processor, causes the processor to perform functions relating to these processes.

As used in this specification and any claims of this application, the terms "computer", "server", "processor", and "memory" all refer to electronic or other technological devices. These terms exclude people or groups of people. As used herein, the terms "computer readable medium" and "computer readable media" refer generally to tangible, physical, and non-transitory electronic storage mediums that store information in a form that is readable by a computer.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., a web page) to a client device (e.g., for purposes of displaying data to and receiving user input from a user interacting with the client device).

Data generated at the client device (e.g., a result of the user interaction) can be received from the client device at the server.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

As described above, embodiments of the present disclosure are particularly useful for optimizing coiled tubing string configurations for drilling operations. In one or more embodiments of the present disclosure, a method for optimizing coiled tubing string configurations for drilling operations includes: determining a plurality of sections for a wellbore to be drilled along a planned trajectory through a subsurface formation; determining physical properties of a coiled tubing string for drilling the wellbore along the planned trajectory, the coiled tubing string having a non-rotatable segment and a rotatable segment; estimating a length of the rotatable segment of the coiled tubing string, based on the physical properties corresponding to the rotatable segment; calculating a friction factor for the rotatable segment based on the estimated length of the rotatable segment; estimating an effective axial force for one or more points of interest along the non-rotatable and rotatable segments of the coiled tubing string, based in part on the friction factor calculated for the rotatable segment; upon determining that the effective axial force for at least one of the one or more points of interest exceeds a predetermined maximum force threshold, estimating an effective distributive friction factor for at least a portion of the non-rotatable segment of the coiled tubing string; and redefining the rotatable and non-rotatable segments of the coiled tubing string for one or more of the plurality of sections of the wellbore to be drilled along the planned trajectory, based on the estimated effective distributive friction factor for the portion of the non-rotatable segment.

For the foregoing embodiments, the method or steps thereof may include any of the following elements, either alone or in combination with each other: the effective-distributive friction factor represents a distribution of frictional drag forces over a selected length of the non-rotatable segment of the coiled tubing string along one or more of the plurality of sections of the wellbore; the predetermined maximum force threshold is a predetermined maximum hook load; the effective distributive friction factor is estimated for portions of the non-rotatable segment corresponding to lateral and curved sections of the wellbore along the planned trajectory; the effective distributive friction factor is estimated for a portion of the non-rotatable segment corresponding to a lateral section of the wellbore along the planned trajectory; the rotatable segment of the coiled tubing string includes a downhole motor and a bottom hole assembly, and the downhole motor is located upstream from the bottom hole assembly on the rotatable segment of the coiled tubing string; the non-rotatable segment of the coiled tubing string extends from a surface of the wellbore and attaches to a proximal end of the downhole motor; and the downhole motor is a hydraulic motor.

Also, a system for optimizing coiled tubing string configurations for drilling operations has been described. Embodiments of the system may include at least one processor and a memory coupled to the processor having instructions stored therein, which when executed by the processor, cause the processor to perform functions including functions to: determine a plurality of sections for a wellbore to be drilled along a planned trajectory through a subsurface formation; determine physical properties of a coiled tubing string for drilling the wellbore along the planned trajectory, where the coiled tubing string has a non-rotatable segment and a rotatable segment; estimate a length of the rotatable segment of the coiled tubing string, based on the physical properties corresponding to the rotatable segment; calculate a friction factor for the rotatable segment based on the estimated length of the rotatable segment; estimate an effective axial force for one or more points of interest along the non-rotatable and rotatable segments of the coiled tubing string, based in part on the friction factor calculated for the rotatable segment; determine whether or not the effective axial force for at least one of the one or more points of interest exceeds a predetermined maximum force threshold; estimate an effective distributive friction factor for at least a portion of the non-rotatable segment of the coiled tubing string, when the effective force for at least one of the one or more points of interest is determined to exceed the predetermined maximum force threshold; and redefine the rotatable and non-rotatable segments of the coiled tubing string for one or more of the plurality of sections of the wellbore to be drilled along the planned trajectory, based on the estimated effective distributive friction factor for the portion of the non-rotatable segment. Likewise, a computer-readable storage medium has been described and may generally have instructions stored therein, which when executed by a computer cause the computer to perform a plurality of functions, including functions to: determine a plurality of sections for a wellbore to be drilled along a planned trajectory through a subsurface formation; determine physical properties of a coiled tubing string for drilling the wellbore along the planned trajectory, where the coiled tubing string has a non-rotatable segment and a rotatable segment; estimate a length of the rotatable segment of the coiled tubing string, based on the physical properties corresponding to the rotatable segment; calculate a friction factor for the rotatable segment based on the estimated length of the rotatable segment; estimate an effective axial force for one or more points of interest along the non-rotatable and rotatable segments of the coiled tubing string, based in part on the friction factor calculated for the rotatable segment; determine whether or not the effective axial force for at least one of the one or more points of interest exceeds a predetermined maximum force threshold; estimate an effective distributive friction factor for at least a portion of the non-rotatable segment of the coiled tubing string, when the effective force for at least one of the one or more points of interest is determined to exceed the predetermined maximum force threshold; and redefine the rotatable and non-rotatable segments of the coiled tubing string for one or more of the plurality of sections of the wellbore to be drilled along the planned trajectory, based on the estimated effective distributive friction factor for the portion of the non-rotatable segment.

For any of the foregoing embodiments, the system or computer-readable storage medium may include any of the following elements, either alone or in combination with each other: the effective-distributive friction factor represents a distribution of frictional drag forces over a selected length of the non-rotatable segment of the coiled tubing string along one or more of the plurality of sections of the wellbore; the predetermined maximum force threshold is a predetermined maximum hook load; the effective distributive friction factor is estimated for portions of the non-rotatable segment corresponding to lateral and curved sections of the wellbore along the planned trajectory; the effective distributive friction factor is estimated for a portion of the non-rotatable segment corresponding to a lateral section of the wellbore along the planned trajectory; the rotatable segment of the coiled tubing string includes a downhole motor and a bottom hole assembly, and the downhole motor is located upstream from the bottom hole assembly on the rotatable segment of the coiled tubing string; the non-rotatable segment of the coiled tubing string extends from a surface of the wellbore and attaches to a proximal end of the downhole motor; and the downhole motor is a hydraulic motor.

While specific details about the above embodiments have been described, the above hardware and software descriptions are intended merely as example embodiments and are not intended to limit the structure or implementation of the disclosed embodiments. For instance, although many other internal components of the system 600 are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

What is claimed is:

1. A computer-implemented method for optimizing coiled tubing string configurations for drilling operations, the method comprising:

determining, by a control system of a coiled tubing string for drilling a wellbore along a planned trajectory through a subsurface formation, physical properties of the coiled tubing string, the coiled tubing string having a non-rotatable segment and a rotatable segment, the non-rotatable segment extending from a surface pump into the wellbore and attaching to a downhole motor at a proximal end of the rotatable segment within the wellbore, and the physical properties including at least one of a weight of the coiled tubing string or a torsional yield strength of tubing material associated with each segment of the coiled tubing string;

estimating, by the control system, a length of the non-rotatable segment of the coiled tubing string for drilling one or more sections of the wellbore along the planned trajectory, based on the physical properties of the coiled tubing string corresponding to the non-rotatable segment;

calculating, by the control system, pressure drop values for a plurality of points of interest along the coiled tubing string excluding the downhole motor and the rotatable segment, based on a capacity of the surface pump for injecting drilling fluid into the wellbore and the estimated length of the non-rotatable segment of the coiled tubing string;

estimating, by the control system, a length of the rotatable segment of the coiled tubing string within the one or more sections of the wellbore to be drilled, based on the calculated pressure drop values and the physical properties of the coiled tubing string corresponding to the rotatable segment; and controlling, by the control system of the coiled tubing string, one or more operating parameters of the coiled tubing string while drilling the one or more sections of the wellbore through the subsurface formation, based on the estimated lengths of the respective non-rotatable and rotatable segments of the coiled tubing string, the operating parameters including a rotation rate of the rotatable segment and a flow rate of the drilling fluid injected by the surface pump.

2. The method of claim 1, further comprising:

estimating an effective distributive friction factor for the rotatable segment of the coiled tubing string, based on the estimated length of the rotatable segment and the corresponding physical properties, wherein the effective-distributive friction factor represents a distribution of frictional drag forces over a selected length of the non-rotatable segment of the coiled tubing string along the one or more sections of the wellbore;

calculating an effective axial force for one or more of the plurality points of interest along the non-rotatable and rotatable segments of the coiled tubing string, based in part on the effective distributive friction factor estimated for the rotatable segment;

responsive to determining that the effective axial force for at least one of the one or more points of interest exceeds a predetermined maximum hook load threshold, estimating an effective distributive friction factor for at least a portion of the non-rotatable segment of the coiled tubing string; and refining the estimated length of the non-rotatable segment of the coiled tubing string for the one or more sections of the wellbore to be drilled along the planned trajectory, based on the estimated effective distributive friction factor for the portion of the non-rotatable segment.

3. The method of claim 2, wherein the predetermined maximum hook load threshold is specified by a user via a graphical user interface (GUI) of a well engineering application executable by a surface processing unit of the control system.

4. The method of claim 2, wherein the effective distributive friction factor is estimated for portions of the non-rotatable segment corresponding to lateral and curved sections of the wellbore along the planned trajectory.

5. The method of claim 2, wherein the effective distributive friction factor is estimated for a portion of the non-rotatable segment corresponding to a lateral section of the wellbore along the planned trajectory.

6. The method of claim 1, wherein the rotatable segment of the coiled tubing string extends from the downhole motor to a bottom hole assembly located at a distal end of the coiled tubing string.

7. The method of claim 6, wherein the non-rotatable segment of the coiled tubing string extends from a spool coupled to the surface pump at a surface of the wellbore and attaches to a twisting-restraining tool at a proximal end of the downhole motor, and a distal end of the downhole motor attaches to the rotatable segment of the coiled tubing string within the wellbore.

8. The method of claim 6, wherein the downhole motor is a hydraulic motor.

9. A system for optimizing coiled tubing string configurations for drilling operations, the system comprising:

a coiled tubing string to drill a wellbore along a planned trajectory through a subsurface formation, the coiled tubing string having a non-rotatable segment and a rotatable segment, the non-rotatable segment extending from a surface of the wellbore and attaching to a downhole motor at a proximal end of the rotatable segment within the wellbore;

a surface pump coupled to a proximal end of the coiled tubing string to inject drilling fluid into the wellbore as it is drilled along the planned trajectory; and a control system coupled to the coiled tubing string and the surface pump to perform a plurality of functions, including functions to:

determine physical properties of the coiled tubing string, the physical properties including at least one of a weight of the coiled tubing string or a torsional yield strength of tubing material associated with each segment of the coiled tubing string;

estimate a length of the non-rotatable segment of the coiled tubing string for drilling one or more sections of the wellbore along the planned trajectory, based on the physical properties of the coiled tubing string corresponding to the non-rotatable segment;

calculate pressure drop values for a plurality of points of interest along the coiled tubing string excluding the downhole motor and the rotatable segment, based on a capacity of the surface pump to inject the drilling fluid into the wellbore and the estimated length of the non-rotatable segment of the coiled tubing string;

estimate a length of the rotatable segment of the coiled tubing string within the one or more sections of the wellbore to be drilled, based on the calculated pressure drop values and the physical properties of the coiled tubing string corresponding to the rotatable segment; and control one or more operating parameters of the coiled tubing string while drilling the one or more sections of the wellbore through the subsurface formation, based on the estimated lengths of the respective non-rotatable and rotatable segments of the coiled tubing string, the operating parameters including a rotation rate of the rotatable segment and a flow rate of the drilling fluid injected by the surface pump.

10. The system of claim 9, wherein the plurality of functions performed by the control system further include functions to:

calculate an effective axial force for one or more of the plurality points of interest along the non-rotatable and rotatable segments of the coiled tubing string, based in part on the effective distributive friction factor estimated for the rotatable segment, wherein the effective-distributive friction factor represents a distribution of frictional drag forces over a selected length of the non-rotatable segment of the coiled tubing string along the one or more sections of the wellbore;

determine whether or not the effective axial force for at least one of the one or more points of interest exceeds a predetermined maximum hook load threshold;

estimate an effective distributive friction factor for at least a portion of the non-rotatable segment of the coiled tubing string, when the effective force for at least one of the one or more points of interest is determined to exceed the predetermined maximum hook load threshold; and refine the estimated length of the non-rotatable segment of the coiled tubing string for the one or more sections of the wellbore to be drilled along the planned trajectory, based on the estimated effective distributive friction factor for the portion of the non-rotatable segment.

11. The system of claim 10, wherein the predetermined maximum hook load threshold is specified by a user via a graphical user interface (GUI) displayed by a surface processing unit of the control system.

12. The system of claim 10, wherein the effective distributive friction factor is estimated for portions of the non-rotatable segment corresponding to lateral and curved sections of the wellbore along the planned trajectory.

13. The system of claim 10, wherein the effective distributive friction factor is estimated for a portion of the non-rotatable segment corresponding to a lateral section of the wellbore along the planned trajectory.

14. The system of claim 9, wherein the rotatable segment of the coiled tubing string extends from the downhole motor to a bottom hole assembly located at a distal end of the coiled tubing string.

15. The system of claim 14, wherein the non-rotatable segment of the coiled tubing string extends from a spool coupled to the surface pump at the surface of the wellbore and attaches to a twisting-restraining tool at a proximal end of the downhole motor, and a distal end of the downhole motor attaches to the rotatable segment of the coiled tubing string within the wellbore.

16. The system of claim 14, wherein the downhole motor is a hydraulic motor.

17. A computer-readable storage medium having instructions stored therein, which when executed by a computer cause the computer to perform a plurality of functions, including functions to:

determine physical properties of a coiled tubing string for a wellbore to be drilled along a planned trajectory through a subsurface formation, the coiled tubing string having a non-rotatable segment and a rotatable segment, the non-rotatable segment extending from a surface pump into the wellbore and attaching to a downhole motor at a proximal end of the rotatable segment within the wellbore, and the physical properties including at least one of a weight of the coiled tubing string or a torsional yield strength of tubing material associated with each segment of the coiled tubing string;

estimate a length of the non-rotatable segment of the coiled tubing string within one or more sections of the wellbore to be drilled along the planned trajectory, based on the physical properties corresponding to the non-rotatable segment;

calculate pressure drop values for a plurality of points of interest along the coiled tubing string excluding the downhole motor and the rotatable segment, based on a capacity of the surface pump to inject drilling fluid into the wellbore and the estimated length of the non-rotatable segment of the coiled tubing string;

estimate a length of the rotatable segment of the coiled tubing string within the one or more sections of the wellbore to be drilled, based on the calculated pressure drop values and the physical properties of the coiled tubing string corresponding to the rotatable segment; and control one or more operating parameters of the coiled tubing string while drilling the one or more sections of the wellbore through the subsurface formation, based on the estimated lengths of the respective non-rotatable and rotatable segments of the coiled tubing string, the operating parameters including a rotation rate of the rotatable segment and a flow rate of the drilling fluid injected by the surface pump.

18. The computer-readable storage medium of claim 17, wherein the plurality of functions further include functions to:

estimate an effective distributive a friction factor for the rotatable segment of the coiled tubing string, based on the estimated length of the rotatable segment and the corresponding physical properties, wherein the predetermined maximum hook load threshold is specified by a user via a graphical user interface (GUI);

calculate an effective axial force for one or more of the plurality points of interest along the non-rotatable and rotatable segments of the coiled tubing string, based in part on the effective distributive friction factor estimated for the rotatable segment;

determine whether or not the effective axial force for at least one of the one or more points of interest exceeds a predetermined maximum hook load threshold;

estimate an effective distributive friction factor for at least a portion of the non-rotatable segment of the coiled tubing string, when the effective force for at least one of the one or more points of interest is determined to exceed the predetermined maximum hook load threshold, the effective-distributive friction factor of the non-rotatable segment representing a distribution of frictional drag forces along the non-rotatable segment of the coiled tubing string within the one or more sections of the wellbore; and refine the estimated length of the non-rotatable segment of the coiled tubing string for the one or more sections of the wellbore to be drilled along the planned trajectory, based on the estimated effective distributive friction factor for the portion of the non-rotatable segment.

19. The computer-readable storage medium of claim 18, wherein the effective distributive friction factor is estimated for portions of the non-rotatable segment corresponding to lateral and curved sections of the wellbore along the planned trajectory.

20. The computer-readable storage medium of claim 18, wherein the effective distributive friction factor is estimated for a portion of the non-rotatable segment corresponding to a lateral section of the wellbore along the planned trajectory.

* * * * *